US006164317A

United States Patent [19]

Hanson

[11] Patent Number: 6,164,317

[45] Date of Patent: Dec. 26, 2000

[54] SEWER PIPE COVER ASSEMBLY

[76] Inventor: Robert Hanson, 516 Summit Ave., Syracuse, N.Y. 13220

[21] Appl. No.: 09/500,978

[22] Filed: Feb. 15, 2000

[51] Int. Cl.[7] ..... F16K 27/08

[52] U.S. Cl. ..... 137/377; 137/315.41; 137/380; 137/382

[58] Field of Search ..... 137/377, 382, 137/315.41, 380

[56] References Cited

U.S. PATENT DOCUMENTS

| | | | |
|---|---|---|---|
| 535,929 | 3/1895 | Stuart . | |
| 3,942,681 | 3/1976 | Richardson . | |
| 4,162,740 | 7/1979 | Jones | 220/728 |
| 4,212,315 | 7/1980 | Fahl et al. | 137/377 |
| 4,915,137 | 4/1990 | Hall et al. . | |
| 5,035,265 | 7/1991 | Chen . | |
| 5,062,325 | 11/1991 | McCauley . | |
| 5,329,971 | 7/1994 | Condon . | |
| 5,379,802 | 1/1995 | VanderLans . | |
| 5,694,978 | 12/1997 | Heilmann et al. . | |
| 5,785,090 | 7/1998 | VanderLans . | |
| 5,816,288 | 10/1998 | Zelch | 137/587 |
| 5,871,030 | 2/1999 | Agbay | 137/364 |

*Primary Examiner*—A. Michael Chambers
*Assistant Examiner*—Thomas L. McShane
*Attorney, Agent, or Firm*—George R. McGuire; Hancock & Estabrook, LLP

[57] ABSTRACT

A cover assembly for a sewer vent pipe having a dome-shaped cap member with a plurality of brackets affixed to the inner surface thereof and extending to surfaces in a common plane for supporting the cap upon the open, upper end of the sewer pipe. A circular support plate is fixedly attached to the surfaces of the brackets and has a central opening for loose passage of a screw a first plurality of additional openings having centers lying on a circle concentrically surrounding the central opening, and a second plurality of additional openings. The screw is threadedly engaged with a tapped opening in a spreader plate. A plurality of lock arms extend through corresponding ones of said first plurality of additional openings. Each lock arm has an edge engaged in a notch in the periphery of the spreader plate, inhibiting rotation thereof. A screwdriver may be inserted through an opening in the cap to engage the head of the screw and impart rotation thereto, thereby causing the spreader plate to travel axially on the screw and to move foot portions of the lock arms outwardly and inwardly with respect to the screw axis by camming action. In operation, the cap is placed over the end of the vent pipe, in spaced, surrounding relation thereto, with the brackets resting on the upper end of the pipe. A screwdriver is inserted through an opening in the cap and engaged with the screw head. The screw is rotated to move the spreader plate upwardly and the lock arms outwardly into frictional engagement with the inside of the pipe. In order to remove the cap, the screwdriver is again inserted and the screw is rotated in the opposite direction, moving the spreader plate downwardly and the lock arms inwardly, away from the pipe. Thus, the cap may be easily installed and removed, but only by those familiar with its structure.

20 Claims, 6 Drawing Sheets

FIG. 8A
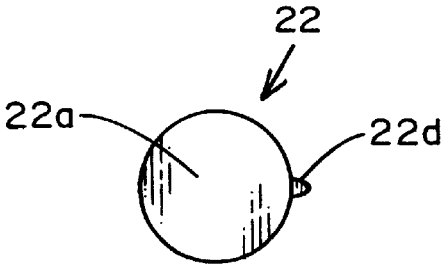
FIG. 8B
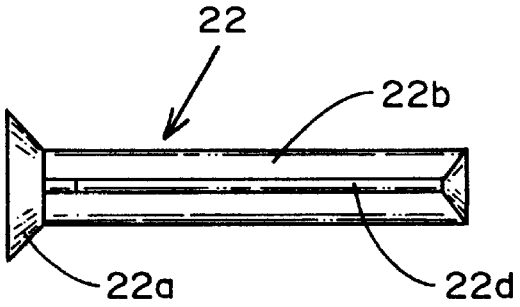
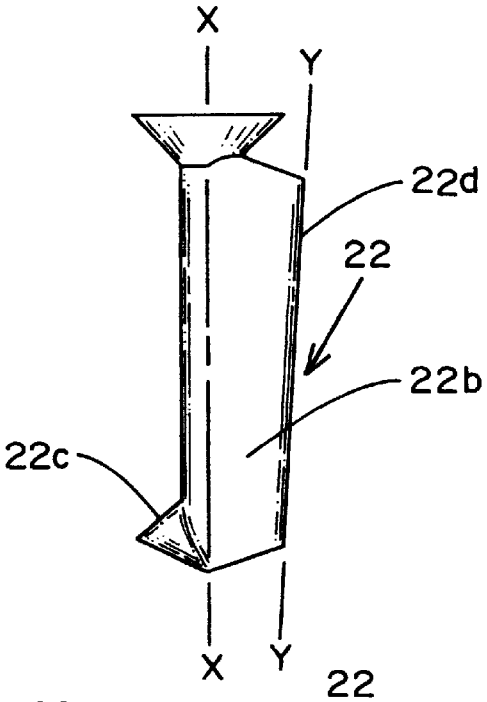
FIG. 8C
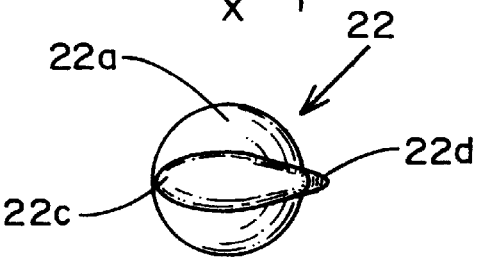
FIG. 8D

SEWER PIPE COVER ASSEMBLY

BACKGROUND OF THE INVENTION

The present invention relates to covers for assembly and use with the upper end of vertically extending sewer vent pipes, and more specifically to dome-shaped covers having improved means for releasably engaging the cover with the vent pipe.

Typical sewer pipe covers in use at the present time are fastened to the sewer pipe by screws, bolts and/or nuts which are easily accessible for loosening or removal of the cover from outside the cover. That is, the covers may be easily removed by anyone wishing to do so, often requiring no tools. Once the cover is removed, the pipes may be easily vandalized by stuffing foreign objects therein to defeat the intended venting function.

It is a principal object of the present invention to provide a sewer vent pipe cover assembly which discourages removal from the vent pipe with which it is associated, thereby reducing the opportunity to clog or otherwise vandalize the pipe.

Another object is to provide a sewer vent pipe cover which cannot be released from engagement with the pipe by manipulation of elements accessible on the exterior of the cover.

A further object is to provide a novel and improved sewer vent pipe cover which may be easily installed and removed by those with knowledge of its structure and operation, but which is not operable in an obvious manner by those without such knowledge.

Other objects will in part be obvious and will in part appear hereinafter.

SUMMARY OF THE INVENTION

The pipe cover of the present invention includes a hemispherical cap welded to a depending, cylindrical skirt or extension. Three brackets are riveted to the cap at equal angular intervals about a circle concentrically surrounding the central axis of the cap. The brackets extend from the inner surface of the cap parallel to its central axis, thence outwardly, perpendicularly to the axis in a plane near that of the juncture of the cap and the cylindrical extension, and terminates in a downwardly extending lip. For convenience, terms such as above, below, upper, lower, vertical, horizontal, etc. will be used to describe orientations of certain elements with the understanding that the cover assembly of the invention is normally installed on a pipe with a vertical axis, and it is with reference to such an installed orientation that such terms are used. Thus, "vertical" would correspond to the orientation of the central or polar axis of the hemisphere which forms the cap, and "horizontal" would correspond, for example, to the equatorial plane of the cap.

A circular plate, termed a support plate, is welded at its outer periphery to the horizontal portions of the three brackets. The support plate includes a central opening and four openings having centers equally spaced from the central opening and arranged at 90 degree intervals near the outer periphery of the support plate. These four openings are countersunk on the upper side of the plate and each have, for purpose described later, a notch in their peripheries. Twelve additional, through openings are formed in the support plate, three having centers on each of four radial lines extending from the center of the plate at 90 degree intervals, equally spaced between radial lines from the center of the plate through the centers of the notched openings.

An additional plate, termed a spreader plate, includes four arms extending outwardly at 90 degree intervals from a central portion. A V-shaped notch is formed in the end of each arm. An opening through the center of the spreader plate is tapped for threaded engagement of a machine screw which extends through the central opening in the support plate with a small clearance. The head of the screw rests on the upper surface of the support plate and the screw threads are engaged in the tapped opening in the spreader plate. The screw may be engaged by a screwdriver extending through a slit in a layer of flexible material, e. g., a rubber pad cemented to the inner surface of the cap in covering relation to a through opening concentric with the central axis of the cap.

Four identical, elongated members, termed lock arms, extend through the four notched openings in the support plate. Each of the lock arms has integral head, body and foot portions. The head portion has a flat upper surface and a conical side surface which mates with the countersink surrounding each notched opening in the support plate. The notch in the periphery of the opening through which the lock arm extends provides clearance for a linear, longitudinally extending edge of the body portion as the lock arms are inserted. The same linear edge of each lock arm also extends into the V-shaped notch in the end of a respective arm of the spreader plate.

When the longitudinal axis of a lock arm is coaxial with the central axis of the support plate opening through which it extends, the linear edge on the body portion which is engaged in the V-shaped notch in the spreader plate is disposed at an angle to these axes. That is, a line extending along the body portion edge is not parallel with the longitudinal axis of the body portion, instead tapering away from this axis (toward the central axis of the spreader plate from bottom to top. Thus, as the screw passing loosely through the support plate central opening is rotated without axial movement, the spreader plate travels axially on the screw, moving upwardly, toward the support plate, in response to clockwise rotation of the screw. As the spreader plate moves upwardly, the lock arms are rotated by virtue of contact of the edge on the body portion with the arms of the spreader plate within the V-shaped notches therein, and because the edge is not parallel to the direction of movement of the spreader plate.

The cover assembly is placed upon the upper, open end of a vertically extending sewer pipe with the horizontal portions of the brackets outwardly of the support plate resting on the terminal end of the pipe. In this position, the support plate is disposed within, and essentially closes, the upper end of the pipe, and the lock arms and spreader plate are disposed within the pipe, below the support plate. After placing the cover assembly upon the upper end of a sewer pipe in this manner, a screwdriver is inserted through the cap to engage and rotate the machine screw. As the spreader plate moves upwardly, the lock arms are rotated until the foot portion of each is moved into frictional engagement with the inner wall of the sewer pipe, thereby releasably installing the cover on the sewer pipe which is vented through the aforementioned twelve openings in the support plate.

Features of construction, installation and operation of the cover assembly of the invention will be more clearly understood and fully appreciated from the following detailed description, taken in conjunction with the accompanying drawings.

BRIEF DESCRIPTION OF THE DRAWINGS

FIGS. 8A, 8B, 8C and 8D are top plan, front elevational, side elevational and bottom plan views, respectively, of another element of the invention.

DETAILED DESCRIPTION

Figure 1:
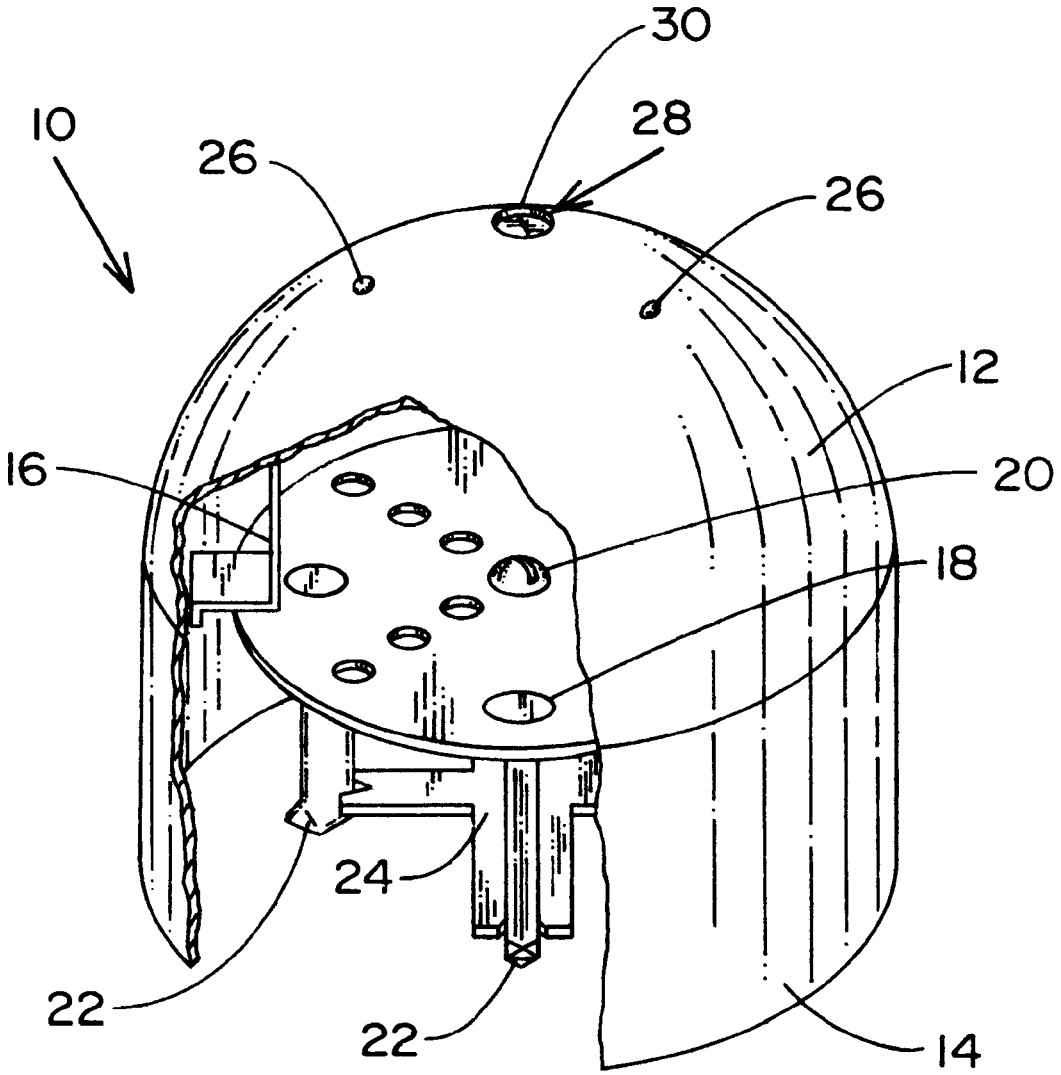
FIG. 1 is a top perspective view, with portions broken away, of the cover assembly of the invention in fully assembled condition.

Turning now to the drawings, in FIG. 1 is shown a fully assembled, preferred embodiment of the sewer pipe cover assembly of the invention, denoted generally by reference numeral 10. Cover assembly 10 includes hemispherical cap 12 and cylindrical cap extension 14 which are welded together at a number of places about their mating peripheries. Three brackets, one of which is seen in FIG. 1, denoted by reference numeral 16, are riveted to the inside of cap 12. Support plate 18 is welded to each of the brackets and contains a number of through openings, described later in more detail, including a central opening through which machine screw 20 passes. The assembly is completed by four identical lock arms 22, two of which are seen in FIG. 1, and spreader plate 24.

Figure 2:
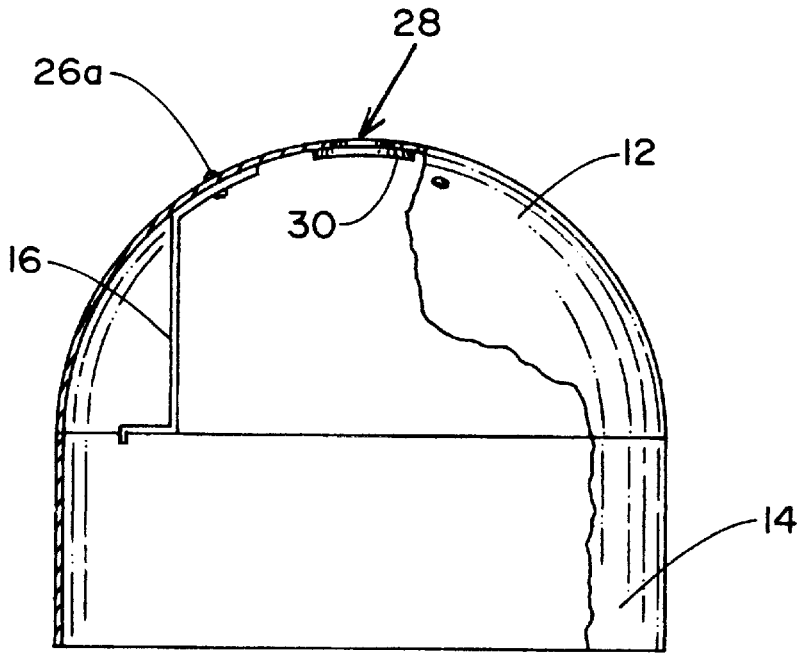
FIG. 2 is a front elevational view, with portions broken away, of a subassembly of the cover assembly of FIG. 1.
Figure 3:
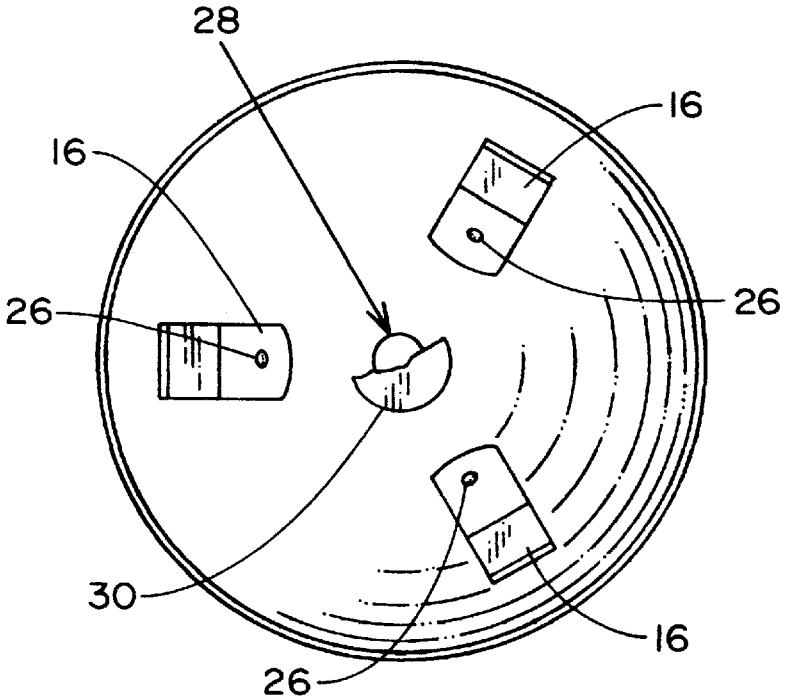
FIG. 3 is a bottom plan view of the elements of FIG. 2.

The cap and bracket subassembly is shown separately in FIGS. 2 and 3. Brackets 16 are fastened to the inner surface of cap 12 by rivets 26, passing through curved portions of the brackets. Through opening 28 is formed concentrically with the polar or central axis of hemispherical cap 12 and is covered by rubber pad 30 which is cemented to the inner surface of the cap. As is apparent from the bracket 16 seen in FIG. 2, the brackets extend from their attachments to the cap in a direction parallel to the cap axis, essentially to the plane of the juncture of cap 12 and extension 14, and thence outwardly in this plane, and terminate in a downwardly extending lip.

Figure 4A:
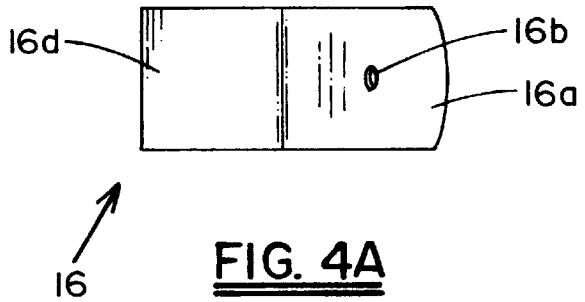
FIGS. 4A, 4B and 4C are top plan, side elevational and front elevational views, respectively, of one of the elements of the subassembly of FIGS. 2 and 3.
Figure 4B:
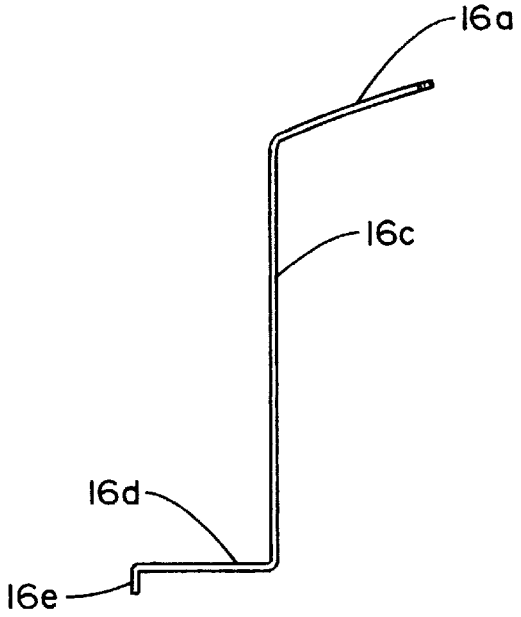
Figure 4C:
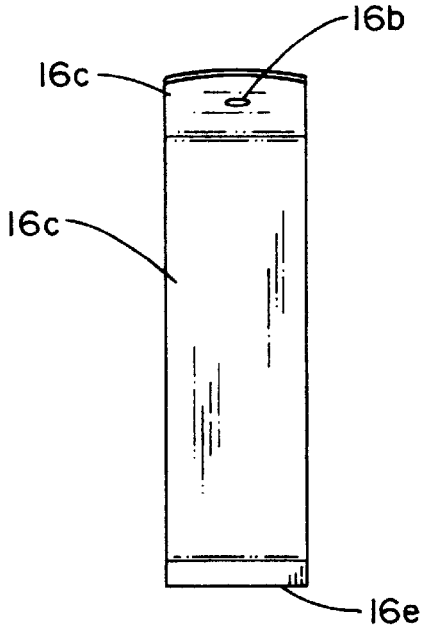

One of the three identical brackets 16 is shown in more detail in FIGS. 4A–4C. Portion 16*a* contacts the inner surface of cap 12 and includes opening 16*b* for the rivet by which the bracket is attached to the cap. Portion 16*c* extends linearly, parallel to the cap axis and portion 16*d* extends linearly, perpendicular to the cap axis. The bracket terminates in downwardly extending lip 16*e*.

Figure 5A:
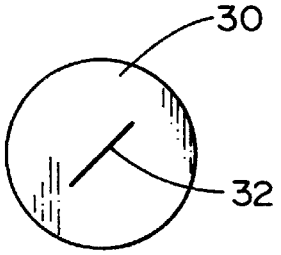
FIGS. 5A and 5B are front and side elevational views, respectively, of another element seen in FIGS. 1–3.
Figure 5B:
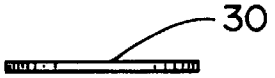

Circular pad 30, of rubber or other such flexible material, is seen in FIGS. 5A and 5B. Pad 30 is cemented to the inside surface of cap 12, as seen in FIGS. 1–3, in covering relation to opening 28 in the cap. Slit 32 is provided in pad 30 to permit insertion of a screwdriver for engaging screw 20

Figure 6A:
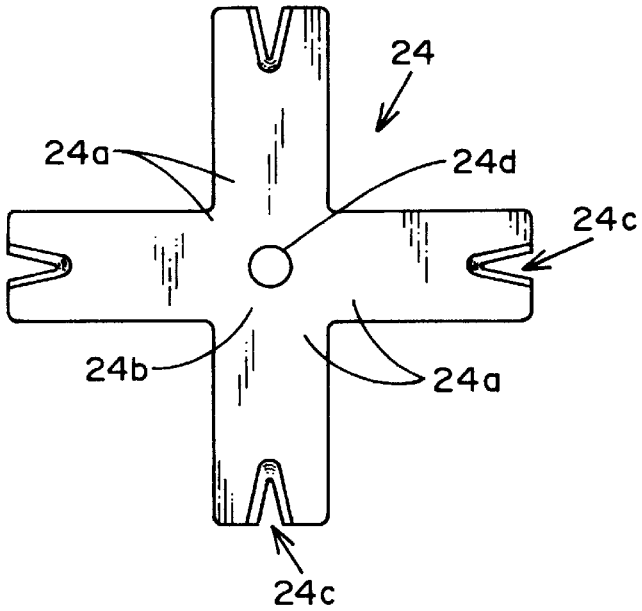
FIGS. 6A and 6B are front and side elevational view, respectively, of another element of the cover assembly.
Figure 6B:
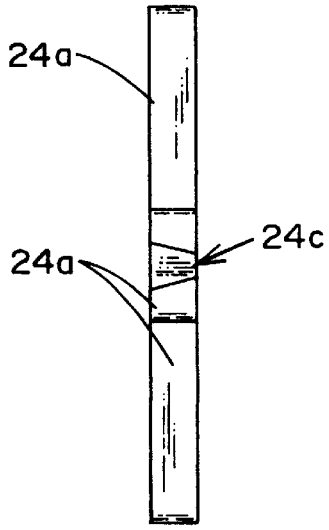

Turning now to FIGS. 6A and 6B, spreader plate 24 is seen to include four arms, each denoted by reference numeral 24*a*, extending at 90 degree intervals from central portion 24*b*. A V-shaped notch 24*c* is formed in the terminal end of each arm 24*a*. The edges of notches 24*c* are preferably beveled, as shown. Central, through opening 24*d* is tapped with threads matching those of screw 20, permitting threaded engagement of spreader plate 24 and screw 20.

Figure 7A:
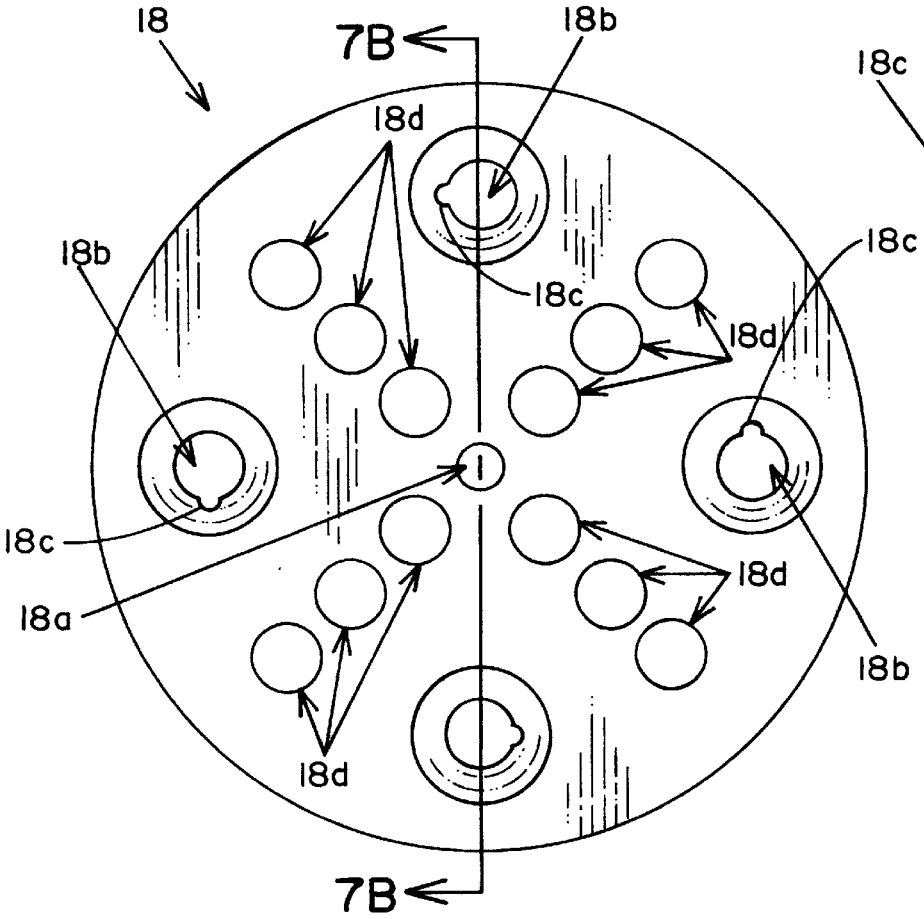
FIG. 7A is a front elevational view of another element of the cover assembly.
Figure 7B:
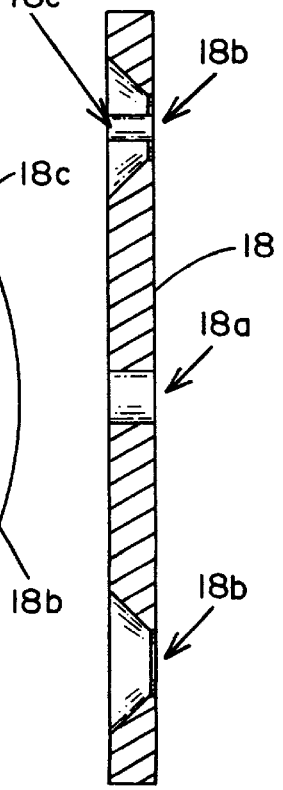
FIG. 7B is a side elevational view, in section on the line 7B—7B of FIG. 7A.

Support plate 18 is shown in greater detail in FIGS. 7A and 7B. Plate 18 has a circular periphery and a number of circular, through openings, including central opening 18*a* which is slightly larger in diameter than screw 20, permitting the screw to pass loosely through the opening and to be rotated without interference from the plate. Four openings 18*b* are formed at 90 degree intervals at equal distances from the central axis of plate 18. Each of openings 18*b* is surrounded by a conical, countersink surface, and a small notch 18*c* is formed in the periphery of each of openings 18*b*. Three openings of equal size are formed with centers on each of four radial lines, at equal, forty five degree intervals between radial lines passing through the centers of openings 18*b*, for a total of twelve openings 18*d*.

One of lock arms 22 is shown in FIGS. 8A–8D and includes head portion 22*a*, body portion 22*b* and foot portion 22*c*. Head portion 22*a* has a flat upper surface and conical side surface, tapering at the same angle as the countersink surfaces surrounding openings 18*b* of support plate 18. Body portion 22*b* is generally elongated and is integrally formed with head portion 22*a*, as well as with foot portion 22*c*. The longitudinal axis of lock arm 22 is indicated by the line X—X in FIG. 8C, passing concentrically through head portion 22*a*. Side surfaces of body portion 22*b* tapers inwardly to a lateral edge 22*d*, lying on an essentially straight line Y—Y, at an acute angle to axis X—X.

Figure 9:
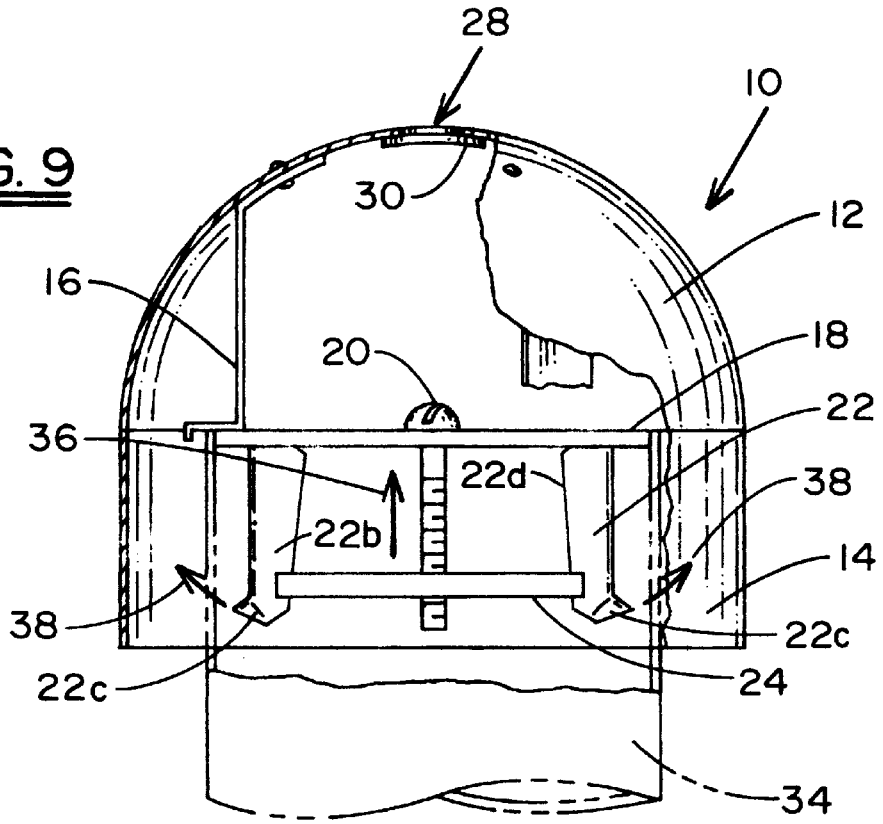
FIGS. 9 and 10 are front elevational views, with portions broken away, of the cover assembly installed on a sewer pipe, shown in phantom lines, with certain movable elements in two different positions.
Figure 10:
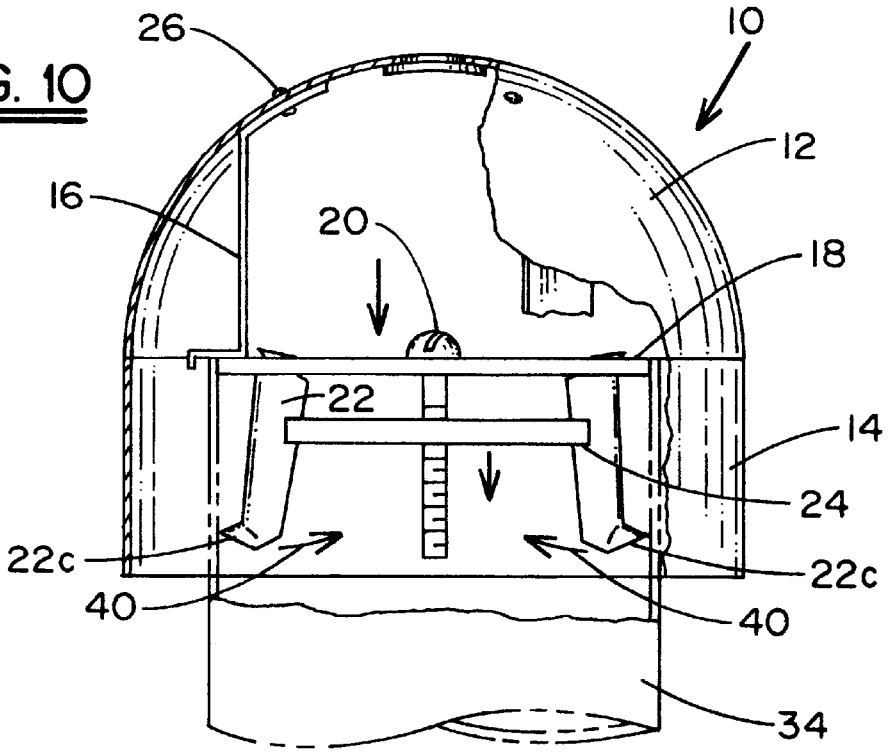

Details of assembly and operation of the elements thus far described, both with one another and with the end of a vertically extending sewer pipe, will be more readily understood with reference to FIGS. 9 and 10. Support plate 18 is welded to each of brackets 16, the welds preferably being at the outer periphery of plate 18 and the lower surface of portions 16*c* of the brackets. One of lock arms 22 is inserted through each of openings 18*b*; notches 18*c* provide clearance for passage of the upper portion of edge 22*d* and the conical surface of head portion 22*a* rests on the conical countersink surrounding the opening. Screw 20 is inserted through opening 18*a* and threaded into opening 24*d* of spreader plate 24. The completed assembly is then placed over the open end of a vertically extending sewer pipe, such as that shown in phantom lines in FIG. 9 and 10 and denoted by reference numeral 34. With the elements in the position shown in FIG. 9, a screwdriver may be inserted through slit 32 in pad 30 and engaged with screw 20. Clockwise rotation of screw, while exerting sufficient downward force on the screw to prevent it from moving upwardly through opening 18*a*, causes spreader plate 24 to move axially upward, as indicated by arrow 36. Since edges 22*d* are tapered toward the central axis of spreader plate 24 from lower to upper end, upward movement of plate 24 rotates lock arms 22 outwardly, as indicated by arrows 38. Stated another way, by upward movement of spreader plate 24, notches 24*c* exert a camming action on edges 22*d*, rotating lock arms 22 until foot portions 22*c* are in firm, frictional engagement with the inner wall of pipe 34, as shown in FIG. 10.

In order to release cover assembly 10 from engagement with pipe 34, the screwdriver is again inserted, engaged with screw 20 and rotated in a counterclockwise direction while exerting enough downward force to prevent upward movement of the screw. This causes spreader plate 24 to travel downwardly, allowing lock arms 22 to rotate in the direction of arrows 40 as the elements are returned to their positions of FIG. 9. The elements are sized for use with a sewer pipe of predetermined diameter; support plate 18 has a diameter slightly smaller than the pipe diameter and the pipe is principally vented through openings 18*d*.

What is claimed is:

1. A removable cover assembly for installation on the cylindrical, upper, open end of a vertically extending sewer pipe, or the like, of predetermined inside and outside diameter, said cover assembly comprising, in combination:

a) a cap member including a cylindrical portion having an inside diameter greater than said predetermined outside diameter;

b) means for supporting said cap member in spaced and covering relation to said sewer pipe end with said cylindrical portion surrounding and spaced substantially symmetrically outwardly of said pipe for a predetermined axial distance from said open end;

c) means movable into and out of frictional engagement with said pipe for removably securing said cap member in said spaced and covering relation;

d) actuating means having a tool engagement portion covered by said cap member for effecting movement of said movable means into and out of said frictional engagement in response to manual manipulation of a tool engaged with said tool engagement portion; and e) means providing access for passage of said tool through said cap means to engage said tool engagement portion.

2. The cover assembly of claim 1 wherein said cap member includes a substantially hemispherical portion having an inside diameter equal to that of said cylindrical portion and said hemispherical and cylindrical portions are integrally attached.

3. The cover assembly of claim 2 wherein said supporting means comprises a plurality of brackets affixed to and extending from the inner surface of said hemispherical portion.

4. The cover assembly of claim 3 wherein each of said brackets includes a surface portion, all of said bracket surface portions lying in a common plane normal to the axis of said cylindrical portion of said cap member.

5. The cover assembly of claim 4 wherein each of said surface portions extend radially with respect to said hemispherical portion through circles having diameters equal to both said inside and outside predetermined diameters, whereby said surface portions may rest upon said upper end of said pipe and support said cap member with respect thereto.

6. The cover assembly of claim 1 wherein said tool engagement portion comprises a screw head engageable by a screwdriver.

7. The cover assembly of claim 1 wherein said movable means comprise a plurality of arms each having a portion mounted for movement into and out of said frictional engagement with the inner surface of said pipe.

8. The cover assembly of claim 7 wherein said actuating means comprises an elongated, screw and a spreader member having a tapped opening threadedly engaged with said screw, and further comprising means for positioning said screw coaxially with said cylindrical portion of said cap and means for restraining rotation of said spreader member, whereby axially stationary rotation of said screw causes said spreader member to travel axially upon said screw.

9. The cover assembly of claim 8 wherein each of said arms contacts said spreader member and further comprising means mounting said arms for said movement into and out of frictional engagement in response to said axial movement of said spreader member.

10. The cover assembly of claim 9 wherein said mounting means comprises a circular plate having a diameter slightly less than said predetermined inside diameter, a central opening through which said screw freely extends, and a plurality of additional openings having centers lying on a circle concentrically surrounding the center of said plate, one of said arms extending through each of said additional openings.

11. The cover assembly of claim 2 wherein said means providing access for passage of said tool comprises a through opening in said hemispherical portion through which the axis of said cylindrical portion passes.

12. The cover assembly of claim 11 and further including a flexible layer with a slit for passage of said tool affixed to said hemispherical portion in covering relation to said through opening.

13. The cover assembly of claim 12 and further comprising a plurality of brackets having first and second ends and affixed to said cap member at said first end and to said circular plate at said second end.

14. A cover assembly for a sewer vent pipe comprising:

a) a cap member having a hemispherical portion from which a cylindrical portion extends;

b) a plurality of brackets each having first and second ends and affixed at said first ends to the inside of said hemispherical portion and extending therefrom in spaced relation to one another to said second ends which lie in a common plane normal to the axis of said cylindrical portion;

c) a support plate affixed to said second ends of said brackets, said support plate having a central opening, a first plurality of additional openings having centers lying on a circle concentrically surrounding said central opening, and a second plurality of additional openings;

d) a plurality of arms, one of which extends loosely through a corresponding one of said first plurality of additional openings, permitting movement of said arms relative to said support plate;

e) an elongated screw extending loosely through said central opening in said support plate;

f) a spreader plate having a tapped opening threadedly engaged with said screw and restrained against rotation, whereby axially stationary rotation of said screw causes said spreader plate to travel axially on said screw, said arms being engaged by said spreader plate and moved in response to said axial travel of said spreader plate; and g) a through opening in said cap member lying on the axis of said screw.

15. The cover assembly of claim 14 wherein each of said arms includes a head portion, engaging the area of said support plate surrounding said first plurality of additional openings, a body portion, extending through said support plate and having an edge portion engaging said spreader plate, and a foot portion, movable away from and toward said axis of said screw between first and second positions in response to said axial travel of said spreader plate in first and second directions, respectively.

16. The cover assembly of claim 15 wherein said spreader plate is farther from said support plate when in said first position than when in said second position.

17. The cover assembly of claim 16 wherein said edge portion of said body portion of said arm is substantially linear and arranged at an acute angle to said screw axis when said spreader plate is in said first position, whereby said axial travel of said spreader plate from said first to said second position moves said foot portions of said arms outwardly, away from said screw axis, in a camming action.

18. The cover assembly of claim 17 wherein said spreader plate includes a plurality of notches in its periphery and one of said edges of said body portion of said arms is engaged in a corresponding one of said notches, in sliding engagement with said spreader plate as the latter moves between said first and second positions.

19. The cover assembly of claim 14 and further including a layer of flexible material covering said through opening in said cap member, said layer having a slit for passage of an elongated member to engage said screw for rotation thereof.

20. The cover assembly of claim 14 wherein said second ends of said brackets include a surface lying in said common plane and said support plate has a first surface fixedly attached to said surfaces of said brackets and a second surface facing, in spaced, parallel relation, said spreader plate.

* * * * *